United States Patent [19]

Kassai

[11] Patent Number: 4,529,245

[45] Date of Patent: Jul. 16, 1985

[54] COLLAPSIBLE CHAIR

[75] Inventor: Kenzou Kassai, Osaka, Japan

[73] Assignee: Kassai Kabushikikaisha, Osaka, Japan

[21] Appl. No.: 507,486

[22] Filed: Jun. 24, 1983

[30] Foreign Application Priority Data

Jul. 20, 1982 [JP] Japan ..... 57-127201

[51] Int. Cl.[3] ..... A47C 4/00

[52] U.S. Cl. ..... 297/30; 297/35

[58] Field of Search ..... 297/30, 16, 35, 46; 248/166, 168, 169, 434, 439

[56] References Cited

U.S. PATENT DOCUMENTS 1,187,483 6/1916 Barschow ..... 297/30

3,086,812 4/1963 Eads ..... 297/30

3,227,243 1/1966 Bates et al. ..... 297/30 X 4,367,894 1/1983 Manuel ..... 297/35 X

*Primary Examiner*—Philip C. Kannan

*Attorney, Agent, or Firm*—W. G. Fasse; D. H. Kane, Jr.

[57] ABSTRACT

A collapsible chair has a base (1) and a seat portion (2) having a seat (6) disposed above and substantially parallel with the base (1). The seat and the base are connected together by mutually foldable front legs (12), front connecting bars (25), rear legs (13), and rear connecting bars (28). If these parts are folded, the distance between the seat portion (2) and the base (1) can be reduced to achieve a collapsed state in which the dimension in the direction of the height of the chair is reduced.

9 Claims, 11 Drawing Figures

COLLAPSIBLE CHAIR

BACKGROUND OF THE INVENTION

1. Field of the Invention

This invention relates to a collapsible chair and more particularly it relates to improvements in a collapsible chair construction which is advantageously applied to a chair for children generally referred to as a "high chair."

2. Description of the Prior Art

A "high chair" has its seat portion located at a relatively high level, so that by seating a child thereon the child is raised to a level matching with the height of a table for adults. Thus, the use of this "high chair" enables the child to eat or do other things at the same table as adults do.

A "high chair" literally has a large dimension in height and, generally, is usually constructed so that the dimension in height is greater than the dimension in the horizontal direction.

A collapsible chair is advantageous in that it can be stored in compact form when it is not needed. A typical collapsible construction for collapsible chairs is seen, e.g., in a "pipe chair" and in a state after collapse the longitudinal dimension is reduced, providing a relatively thin or flat collapsed configuration. There is a known high chair wherein the collapsible construction of such a "pipe chair" is applied to the "high chair" to make the latter collapsible. However, since a "high chair" is greater in the height dimension than in the horizontal dimension, as described above, the bulk cannot be reduced so much, even if there is obtained a collapsed state in which the longitudinal dimension is reduced as in a "pipe chair." That is, in such "high chair," it is desired that the collapsing action proceed in a direction which reduces the height dimension, whereby a compact collapsed state can be obtained.

SUMMARY OF THE INVENTION

Accordingly, a principal object of this invention is to provide a collapsible chair so constructed that its height dimension can be sufficiently reduced to provide a compact collapsed flat state.

Another object of this invention is to provide a collapsible chair for which the collapsing operation is easy.

In brief, this invention is a collapsible chair including the following features:

(a) A base having a pair of front pivots positioned on both sides near a front end of the base and a pair of rear pivots positioned on both sides of the base between the front and rear ends of the base.

(b) A seat portion having a seat is disposed above and substantially parallel with said base; said seat having a front edge and a rear edge.

(c) A pair of front legs extending upwardly from said front pivots is journalled to said front pivots to be longitudinally rotatable or turnable relative to said front pivots.

(d) A pair of rear legs extending upwardly from said rear pivots is journalled to said rear pivots to be longitudinally rotatable or turnable relative to said rear pivots said pair of rear legs being shorter than said front legs.

(e) Removable locking means are provided for connecting the upper end regions of said rear legs and the intermediate regions of said front legs to fix the angles of the front and rear legs with respect to the base in a state where said front and rear legs substantially converge toward each other.

(f) A pair of front connecting bars is turnably connected at one of their respective ends to the sides of said seat between said front and rear edges and at the other ends thereof to said front legs at positions spaced a predetermined distance downwardly from the upper ends of the front legs.

(g) Rear connecting bars turnably connected at one of their respective ends to relatively rear regions of the sides of said seat and at the other ends thereof to the upper ends of said rear legs.

(h) Arms are turnably connected at one of their respective ends to the upper ends of said front legs and fixedly connected at the other ends thereof to the intermediate portions of said rear connecting bars.

According to this invention, the means for turnably connecting the seat portion to the base is foldable as can be seen between the front legs and the front connecting bars turnably connected thereto and between the rear legs and the rear connecting bars turnably connected thereto. Thus, if the chair is collapsed by utilizing this folding ability, the distance between the seat portion and the base can be reduced in the collapsed state and the height dimension can be sufficiently reduced. If, therefore, this foldability is applied to a chair having a relatively large height from the base to the seat portion, as in a "high chair," the height can be reduced more efficiently to achieve a compact folded state. Further, since the turnable connections between components included in such collapsible chair have substantially parallel axes of rotation, the operation for a change from the opened to the closed state or from the closed to the opened state can be operatively associated by an action in one direction. Therefore, the operations for a change from the opened to the closed state and from the closed state to the opened state can each be performed in a series of similar actions without requiring two or more different procedures.

In a preferred embodiment, the seat portion comprises a backrest extending upwardly, e.g., from the rear edge of the seat and installed turnably with respect to the seat, and armrests extending, e.g., forwardly from the intermediate portion of the backrest and installed turnably with respect to the backrest. Said one end of the rear connecting bar includes an extension which has the associated armrest turnably connected thereto. Thus, the folding of the backrest and armrests in the seat portion is effected along with the folding of the front legs, the rear legs, the front connecting bars and the rear connecting bars. Preferably, the locking means comprises an engaging member turnably connected to the upper ends of the rear legs and having a downwardly opened engaging recess, and an engaging shaft fixed to the front legs and adapted to be received in said engaged recess. The state in which the engaging shaft is received in the engaging recess corresponds to the locked state. Further, the engaging member is held by a rigid link, spring or other means so that it will not hang down. Thus, during the time the chair is changed from its closed to its opened state, the attitude of the engaging member is held somewhat upward, and when the chair is brought into its opened state without applying any manual operation thereto, the engaging shaft can be brought into a state in which it can be directly received in the engaging recess, facilitating the locking operation. In addition, it is preferable that the engaging member be in the form of a flat plate to serve as a footrest as well.

Other objects and features of this invention will become more apparent from the detailed description to be given with reference to the drawings.

DESCRIPTION OF THE PREFERRED EMBODIMENTS AND OF THE BEST MODE OF THE INVENTION

Figure 1:
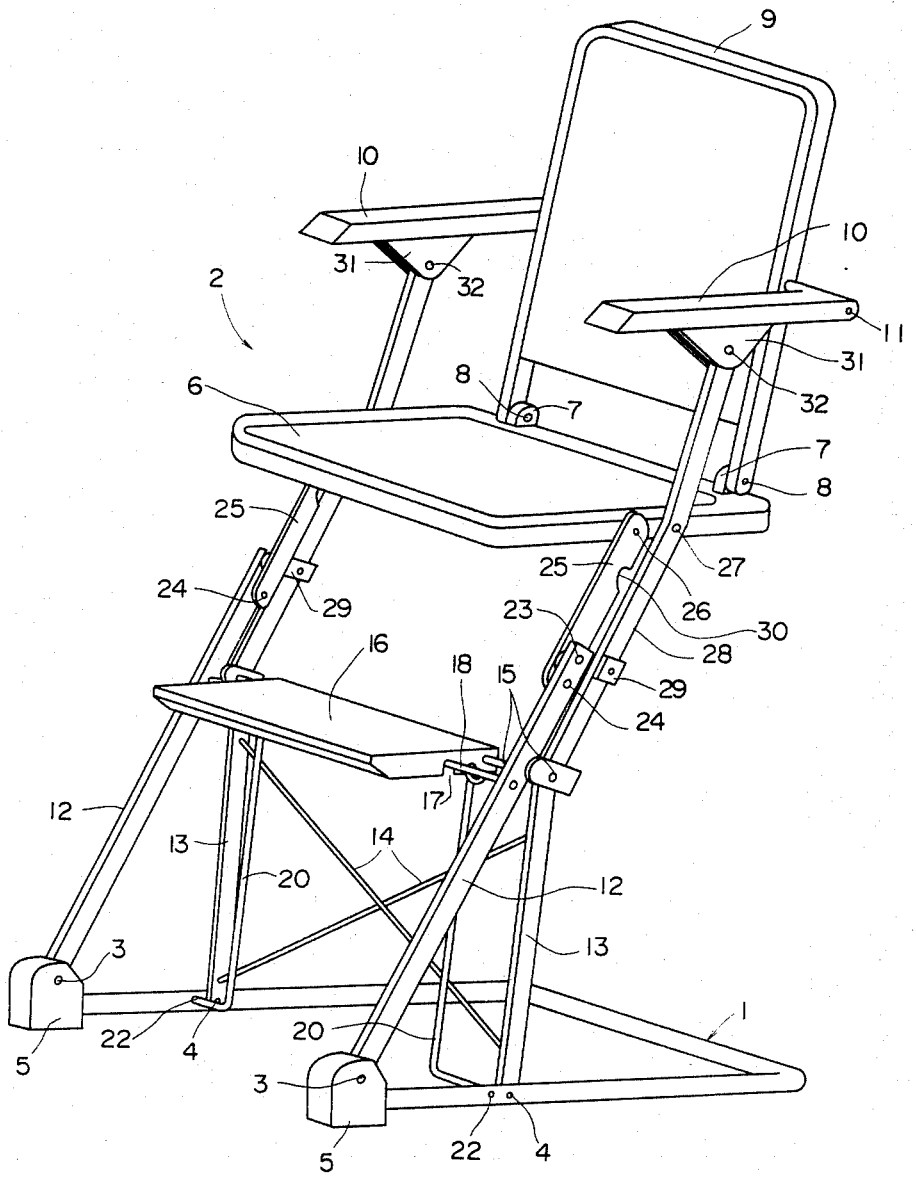
FIG. 1 is a perspective view showing the external appearance of an embodiment of this invention.
Figure 2:
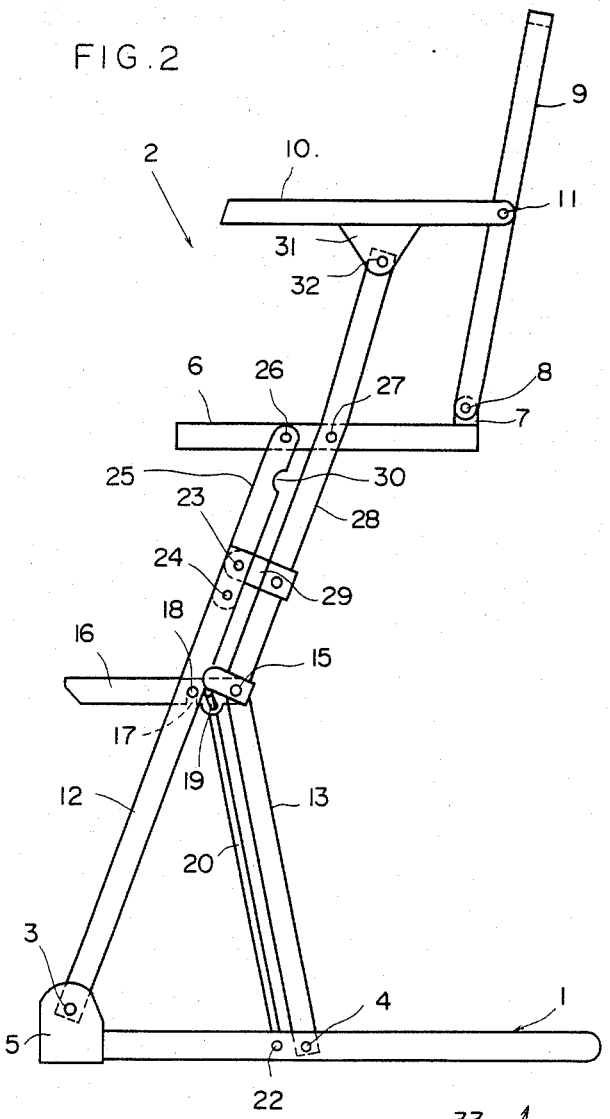
FIG. 2 is a side view of the collapsible chair in FIG. 1.
Figure 2A:
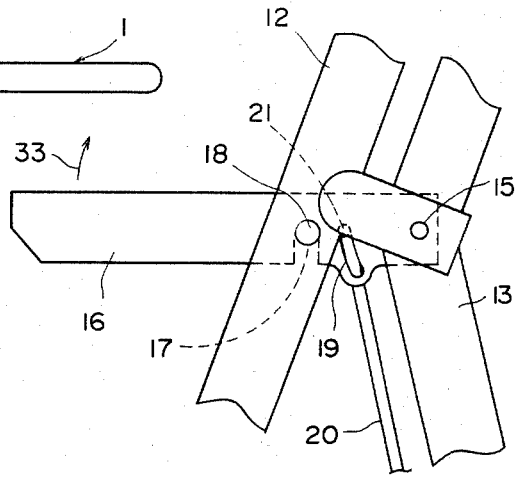
FIG. 2A shows a portion of FIG. 2 on an enlarged scale.

Referring first to FIGS. 1, 2 and 2A, the present chair comprises a base 1 to be placed on the ground or floor, a seat portion 2 disposed above said base 1, and connecting portions which connect said base 1 and said seat portion 2.

The base 1 is formed, e.g., of a single pipe bent into a U-shape. The present chair is not limited to this construction of the base which may be in the form of a plurality of pipes connected together or it may be a plate. The base 1 is provided with a pair of front pivots 3 disposed on both sides in a relatively front region of the base, and a pair of rear pivots 4 disposed between the front and rear end of the base. In the illustrated example, the front pivots 3 are in the form of journal pins held in brackets 5 fixed to the front end of the base 1, while the rear pivots 4 are in the form of journal pins held directly in the base 1.

The seat portion 2 has a seat 6 disposed substantially parallel with the base 1. The rear end of the seat 6 is provided with brackets 7 and by means of pins 8 extending therethrough a backrest 9 is installed for tilting relative to the seat 6. Armrests 10 extend forwardly from the intermediate portion of the backrest 9 and are held turnably or tiltably with respect to the backrest 9 by pins 11.

At the front pivots 3 of the base 1, front legs 3 extend upwardly from the front pivots 3 and are foldable or tiltable about the respective pivot 3. At the rear pivots 4 of the base 1, rear legs 13 extending upwardly therefrom are also foldable or tiltable. The rear legs 13 are shorter than the front legs 12. The pair of rear legs 13 may have a pair of cross bars 14 crossing each other X-wise and connected to the rear legs. The cross bars 14 are for the purpose of reinforcement.

In the opened state of this chair with the front and rear legs 12 and 13 brought close to each other at the upper region of the legs, whereby the upper end portions of the rear legs 13 are connected to the intermediate portions of the front legs 12, the angles which the front and rear legs 12 and 13 form with the base 1 are fixed due to a locking means which will now be described. In the illustrated embodiment, a footrest 16 turnably held by a shaft 15 extending between the upper ends of the pair of rear legs 13 serves as part of this locking means. The lower surface of the footrest 16 has an engaging recess 17 which opens downwardly. An engaging shaft 18 is connected between the intermediate portions of the pair of front legs 12 and is adapted to be received in the engaging recess 17. Thus, when the engaging shaft 18 is received in the engaging recess 17, the locked state of the locking means is obtained.

As best shown in FIG. 2A, each lateral surface of the footrest 16 is formed with an elongated hole 19 describing an arc with the center at the shaft 15. Received in the elongated hole 19 is a bent portion 21 formed by bending one end of a rigid link 20. A bent portion 22 formed by bending the other end of the link 20 is turnably held in the base 1, as shown in FIG. 1.

The links 20 serve to control the attitude of the footrest during collapsing to be described below.

At the upper end of each front leg 12, there are shown two pins 23 and 24 disposed one above the other. Through the lower pin 24 of these pins, the lower end of a front connecting bar 25 is turnably connected to the associated front leg 12. The upper ends of the front connecting bars 25 are turnably connected to relatively front portions of the sides of the seat 6 through pins 26.

Pins 27 are provided in relatively rear portions of the sides of the seat 6, whereby the rear connecting bars 28 are turnably or foldably held in position. The shaft 15 extends through the lower ends of the rear connecting bars 28, whereby the latter are also turnably or foldably connected to the upper ends of the rear legs 13.

A forwardly projecting arm or bracket 29 is fixed to the intermediate portion of each rear connecting bar 28. The front end of the arm or bracket 29 is positioned between the upper end of the associated front leg 12 and the lower end of the associated front connecting bar 25 for turnably or foldably holding the front leg 12 by means of the aforesaid pin 23.

A consideration of the positional relation of the front and rear connecting bars 25 and 28 with respect to the arms 29 will show that the outer lateral surface of the front connecting bar 25 is positioned inwardly of the inner lateral surface of the rear connecting bar 28. Thus, there is defined between the inner lateral surface of the rear connecting bar 28 and the lateral surface of the seat 6 a clearance enough for receiving the thickness of the front connecting bar 25. This functions to make the collapsed state to be later described more compact. The front connecting bar 25 is formed with a notch 30 to receive the pin 27 in the collapsed state so as to allow the front connecting bar 25 to be more horizontal.

The lower surface of each armrest 10 is provided with a bracket 31 which receives an upper extension of the rear connecting bar 28. The armrest 10 is turnably or pivotally connected to an upper extension of the rear connecting bar 28 by a pin 32.

The collapsible chair in the opened state shown in FIGS. 1, 2 and 2A is maintained in its opened state in the following manner. First, the locking means including the footrest 16 and engaging shaft 18 are functioning to connect the upper end portions of the rear legs 13 to the intermediate portions of the front legs in such a condition that the front and rear legs 12 and 13 are brought close to each other or converge toward each other, whereby the angles which the front and rear legs 12 and 13 form with the base are fixed. Thus, the pins 23 and 24 on the front legs 12 and the shaft 15 on the rear legs 13 become fixed points. Therefore, the attitude of the structure comprising the arms or bracket 29 and the rear connecting bars 28 held by the pins 23 and shaft 15 is fixed. Hence, it follows that the pins 27 and 32 on the rear connecting bars 28 become fixed points. Since the pins 27 are fixed points and since the pins 24 are fixed points, as described above, the seat 6 and the front connecting bars 25 have their attitudes fixed. Since the seat 6 assumes the fixed attitudes, the pins 8 are also fixed points and since the pins 32 are also fixed points, as described above, the backrest 9 and armrests 10 have their attitudes fixed. In this way, the elements included in this chair are capable of maintaining their respective attitudes while the locking means 15, 16, 17, 18 are in action.

Next, the operation of closing the collapsible chair which is in the opened state will be described. To close the foldable chair, it is necessary first to cancel the locking action of the locking means. To this end, for example as shown in FIG. 2A, the front end of the footrest 16 is raised in the direction of arrow 33. As a result, the engaging shaft 18 is disengaged from the engaging recess 17, enabling the upper end of the rear legs 13 to move away from the front legs 12. The turning movement of the footrest 16, which permits the engaging shaft 18 to be disengaged from the engaging redcess 17, is in turn permitted by the longitudinal dimension of the elongated hole 19 in which the bent portion of the link 20 is held.

Figure 3:
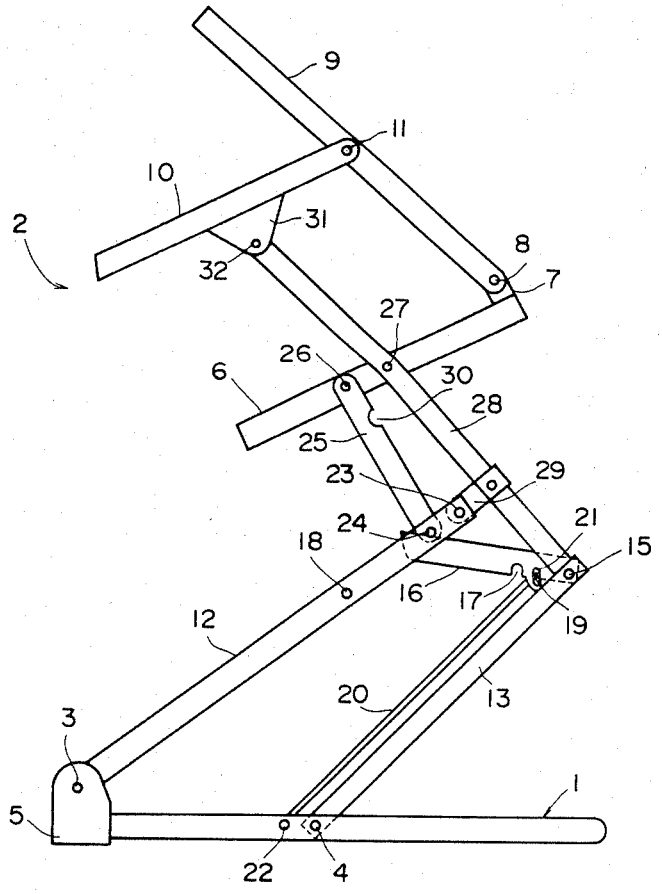
FIG. 3 is a side view of the collapsible chair in FIG. 1 as the chair is being collapsed or folded.

FIG. 3 is a side view of the collapsible chair in FIG. 1 as it is being collapsed. With the lock canceled in the manner described above, if, e.g., the upper end region of the backrest 9 is forwardly pushed, the state shown in FIG. 3 can be obtained. That is, the backrest 9 the, front connecting bars 25, and the rear connecting bars 28 extend from the upper left to the lower right in FIG. 3 while the front legs 12 and the rear legs 13 extend from the lower left to the upper right, while the seat 6 approaches the base 1. In addition, since the footrest 16 is supported by the links 20, it will not hang down.

Figure 4:
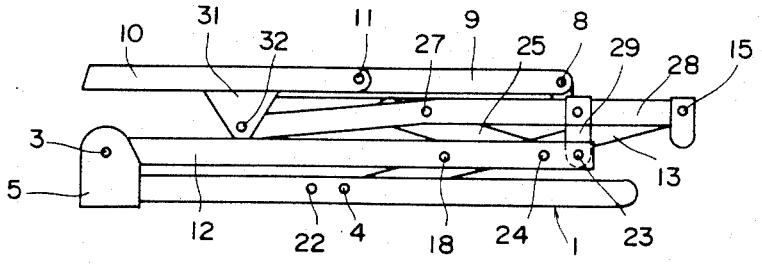
FIG. 4 is a side view of the collapsible chair in FIG. 1 after it has been folded.
Figure 5:
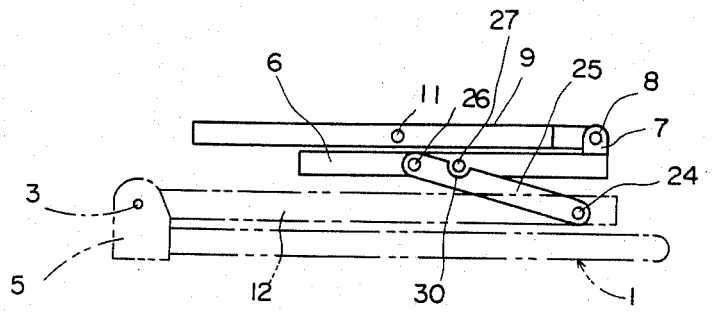
FIGS. 5 and 6 are views diagrammatically showing the attitudes of particular elements included in the collapsible chair which is in the folded state of FIG. 4.
Figure 6:
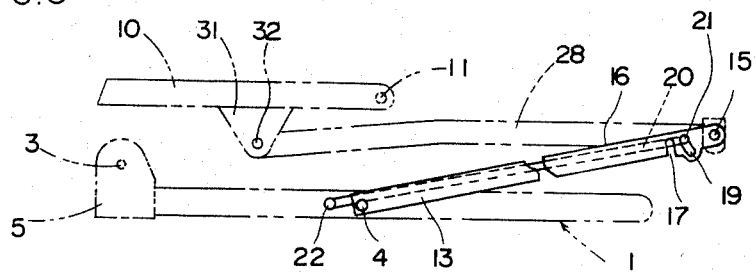

FIG. 4 is a side view of the chair in its state after collapse into the folded condition. FIGS. 5 and 6 are diagrammatic views of the attitudes of particular elements included in the collapsible chair shown in the folded state of FIG. 4. If the FIG. 3 state further progresses, the FIG. 4 state is obtained. Stated briefly, the seat 6, the backrest 8, the armrests 10, the front legs 12, the rear legs 13, the footrest 16, the front connecting bars 25, and the rear connecting bars 28 come close to each other or are placed one above the other thereby extending substantially parallel with the base 1. As is clear from the FIG. 4 state, the height dimension is very much reduced. It will be noted that the front connecting bar 25, as shown in FIG. 5, overlaps the seat 6, receiving the pin 27 in its notch 30. Further, as is clear from FIGS. 4 and 5, the armrest 10 overlaps the backrest 9 and extends in a straight line, the seat 6 is positioned immediately below the backrest 9, and the rear connecting bar 28 overlaps the seat 6 and extends substantially parallel with the seat 6. Further, the front legs 12 extend parallel with the base 1 immediately above the latter and are positioned between the rear connecting bar 28 and the base 1. Further, as is clear from FIGS. 5 and 6, the footrest 16 extends substantially parallel with the rear legs 13 and a portion thereof is positioned below the seat 6.

To change such closed state again to the opened state, this may be attained by raising the right-hand end, i.e., upper end, of the backrest 9 which is in the FIG. 4 state. In response thereto, the state shown in FIGS. 1 and 2 is established, whereby the chair passes through the state of FIG. 3. In the process of change from the closed to the opened state, the action of the links 20 keeps the footrest 16 from hanging down, as shown, e.g., in FIG. 3. This enables the footrest 16 to clear the engaging shaft 18 and advantageously to be positioned above the latter when changing the chair from the closed to the opened state. Thus, if the opened state shown, e.g., in FIG. 2 is established, the engaging recess 17 formed in the lower surface of the footrest 16 can be positioned immediately above the engaging shaft 18. To bring the engaging shaft 18 into engagement with the engaging recess 17 for locking the chair in the open state, this can be attained simply by depressing the footrest 16. In this manner the opened state is reestablished, and this state is positively maintained by the described locking.

In the embodiment described above, the rigid links 20 are used to prevent the footrest 16 from hanging down. However, the invention is not limited thereto, and instead other simple means to be described below may be used for this purpose.

Figure 7:
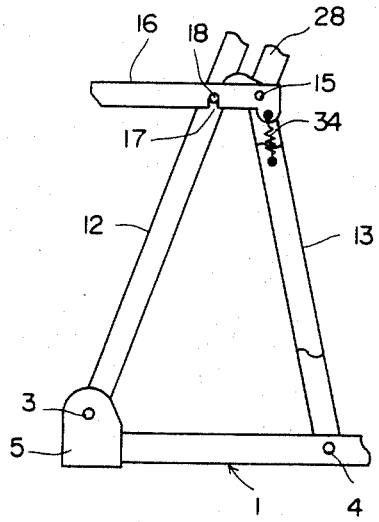
FIG. 7 is a fragmentary side view of another embodiment of this invention shown in the opened state.

FIG. 7 is a fragmentary right-hand side view showing the opened state of another embodiment of this invention. In this embodiment, a spring 34 is used for keeping the footrest 16 from tilting down. The spring 34 is connected between the footrest 16 and the rear leg 13. The spring 34 extends in a direction in which it is substantially aligned with the length of the rear leg 16 for applying a tensile force to the footrest 16.

Figure 8:
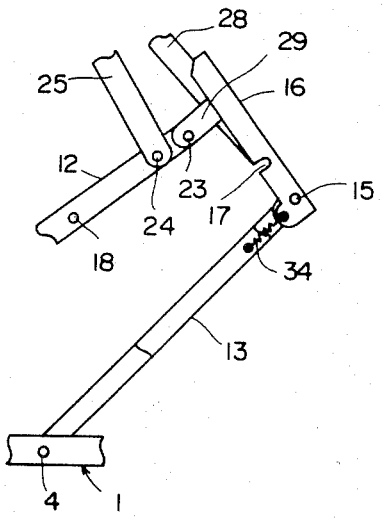
FIG. 8 shows an intermediate state during the collapsing or folding of the collapsible chair of FIG. 7.

FIG. 8 shows an intermediate state of the collapsible chair of FIG. 7 as it is being collapsed or folded, whereby the footrest 16 is kept at a substantially constant angle with respect to the rear leg 13 by the action of the spring 34. Therefore, the footrest 16 will not hang down.

Figure 9:
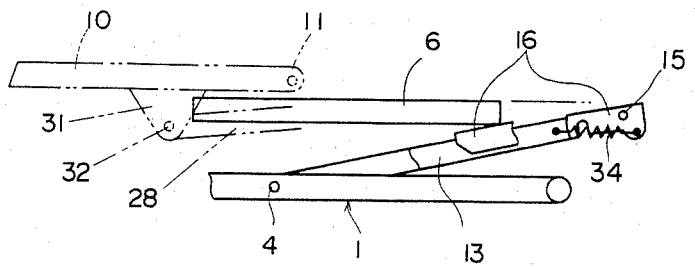
FIG. 9 diagrammatically shows the attitudes of particular elements included in the collapsible chair of FIG. 7 after the folding is completed.

FIG. 9 shows the folded or collapsed state of the chair of FIG. 7, wherein the footrest 16 abuts against the lower surface of the seat 6 which comes down from above during collapse, stretching the spring 34, extending substantially along the rear legs 13 when the chair is stored in this folded condition.

In this embodiment, when the seat 6 ceases to contact the footrest 16 even in the case of a change from the closed to the opened state, the footrest 16 assumes an attitude crossing the rear legs 13 at a substantially constant angle, as shown e.g., in FIG. 8. In the state of FIG. 7 the engaging recess 17 and the engaging shaft 18 are aligned with each other, so that the engaging shaft 18 can be engaged into the engaging recess 17 by pushing down the footrest 16.

In each embodiment described above, the footrest 16 is arranged to serve as an engaging member as well which forms part of the locking means. However, the footrest 16 may be installed as such so that it extends forwardly from the front legs 12, for example. Further, such footrest may be arranged to be foldable along the front legs 12, if desired. To this end, an engaging member having an engaging recess corresponding to the engaging recess 17 forming a portion of the locking means may be installed as a separate part.

Further, in each embodiment described above, the backrest 9 and the armrests 10 forming part of the seat portion 2 are also arranged to be foldable in operative associated with the rear connecting bars 28. However, the invention is not limited thereto, and instead the backrest 9 and armrests 10 may be arranged to be individually foldable.

When such various embodiments of this invention are considered, the essential elements for this invention may be taken to be as follows.

Figure 10:
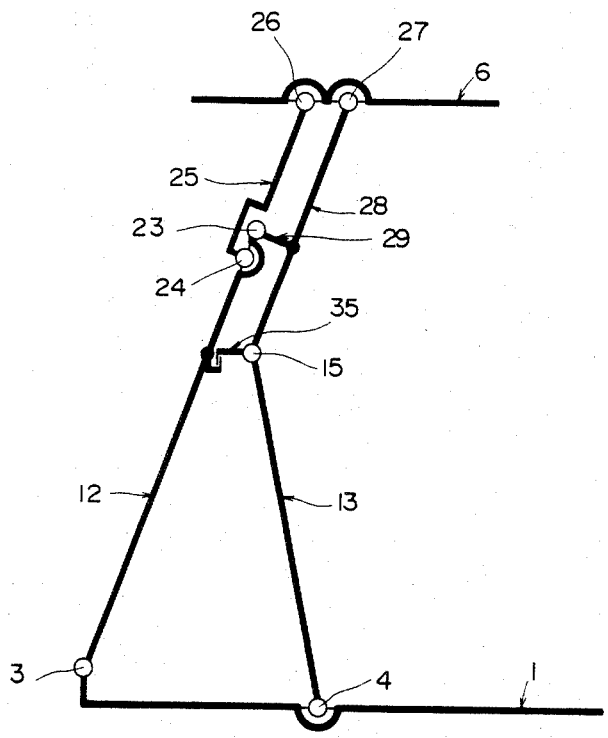
FIG. 10 is a diagrammatic representation of the elements essential to this invention.

FIG. 10 is a diagrammatic view showing the elements essential to this invention. In FIG. 10, the reference numerals used in the preceding embodiments are used for the corresponding parts.

Thus, the base 1 having the front pivots 3 and rear pivots 4 is a first essential element. Next, the seat 6 disposed above the base 1 to extend substantially parallel with the base is another essential element. The front legs 12 extend upwardly from the front pivots 3 to which the front legs 12 are journalled for tilting. The rear legs 13 extend upwardly from the rear pivots 4 and are journalled to said rear pivots 4. The rear legs are shorter than the front legs 12. Also essential is the removable locking means 35 for interconnecting the upper end regions of the rear legs 13 and the intermediate portions of the front legs 12 in a state in which the front and rear legs 12 and 13 converge toward to each other, to thereby fix the angles of the front and rear legs 12 and 13 with respect to the base position. This locking means 35 corresponds to the footrest 16, engaging recess 17 and engaging shaft 18 in the embodiments described above. Essential are the front connecting bars 25 having one of their respective ends journalled to the pins 26 located in a relatively front region of the seat 6 and the other ends journalled to the pins 24 spaced a predetermined distance downwardly from the upper ends of the front legs 12. Further, the rear connecting bars 28 having one of their respective ends journalled to the pins 27 located in a relatively rear region of the seat 6 and the other ends journalled to the shaft 15 located at the upper ends of the rear legs 13 form essential elements. Further, the arms 29 having one of their respective ends journalled to the pins 23 located at the upper ends of the front legs 12 and the other ends fixed to the intermediate portion of the rear connecting bars 28 are essential elements.

In addition, as is clear from the description of FIG. 10, that words indicating direction, such as "front and rear," as used in this specification and the appended claims, are for the sake of convenience and are intended to help understanding the relative positional relation of elements. It is to be pointed out that these words do not necessarily refer to "front and rear" relative to a person sitting on the chair. Therefore, for example, a backrest may be secured to the left hand end of the seat 6 shown in FIG. 10, rather than to the right hand end thereof.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A collapsible chair comprising: a base (1) having a front end, a rear end, a pair of front pivots (3) positioned on both sides in a relatively forward region of said base and a pair of rear pivots (4) positioned on both sides intermediate said front and rear ends of said base; a seat portion (2) having a seat (6) disposed above and substantially parallel with said base (1), said seat having a front edge and a rear edge; a pair of front legs (12) journalled to said front pivots (3) and extending upwardly from said front pivots (3) whereby said front legs are longitudinally turnable relative to said front pivots (3); a pair of rear legs (13) journalled to said rear pivots and extending upwardly from said rear pivots (4) and longitudinally turnable relative to said rear pivots (4), said rear legs being shorter than said front legs (12); removable locking means (16,17,18; or 35) for connecting upper end regions of said rear legs (13) and intermediate regions of said front legs (12) to fix the angles of the front and rear legs (12, 13) with respect to the base (1) in a state where said front and rear legs (12, 13) substantially converge toward each other; a pair of front connecting bars (25) turnably connected at one of their respective ends to sides of said seat (6) intermediate said front edge and rear edge of said seat, the other ends of said pair of connecting bars being connected to said front legs at positions spaced a predetermined distance downwardly from upper ends of said front legs; a pair of rear connecting bars (28) also turnably connected at an upper portion of said rear connecting bars to said sides of said seat (6) rearwardly of the connection of said front connecting bars to the sides of said seat, said rear connecting bars having lower ends turnably connected to upper ends of said rear legs (13); and arms (29) turnably connected at one of their respective ends to the upper ends of said front legs (12) and fixedly connected at the other ends thereof to the intermediate portions of said rear connecting bars (28).

2. The collapsible chair as set forth in claim 1, further comprising a backrest and means securing said backrest to said rear edge of said seat, said backrest (9) extending upwardly from said rear edge of said seat (6), and armrests (10) extending substantially in parallel of said seat, and means securing said armrests to said backrest.

3. The collapsible chair as set forth in claim 2, wherein said backrest (9) is turnably installed with respect to said seat (6), while said armrest (10) are turnably installed with respect to said backrest (9).

4. The collapsible chair as set forth in claim 3, wherein said upper portion of each said rear connecting bars (28) constitutes an extension, and wherein the associated armrest (10) is turnably connected to the upper end of said extension.

5. The collapsible chair as set forth in claim 1, wherein said locking means (16, 17, 18; or 35) includes an engaging member (16) turnably connected to the upper ends of said rear legs (13), said engaging member (16) having a downwardly opened engaging recess (17), said locking means further including an engaging shaft (18) adapted to be received in said engaging recess (17), and means operatively securing said engaging shaft to said front legs in a position for engagement with said recess (17).

6. The collapsible chair as set forth in claim 5, including holding means (20 or 34) for holding said engaging member so that it will not hang down.

7. The collapsible chair as set forth in claim 6, wherein said holding means includes a rigid link (20) connected between said engaging member (16) and said base (1).

8. The collapsible chair as set forth in claim 6, wherein said holding means includes a spring connected between said engaging member (16) and said rear leg (13).

9. The collapsible chair as set forth in claim 5, wherein said engaging member (16) is in the form of a flat plate, serving as a footrest (16).

* * * * *